US006167734B1

(12) United States Patent
Derman

(10) Patent No.: US 6,167,734 B1
(45) Date of Patent: Jan. 2, 2001

(54) SECURITY CABLE COUPLING DEVICE

(76) Inventor: Jay S Derman, P.O. Box 3823, Palos Verdes, CA (US) 90274-9533

( * ) Notice: Under 35 U.S.C. 154(b), the term of this patent shall be extended for 0 days.

(21) Appl. No.: 09/480,567

(22) Filed: Jan. 10, 2000

(51) Int. Cl.[7] ..... E05B 73/00

(52) U.S. Cl. ..... 70/18; 70/49; 70/58; 248/552; 248/553

(58) Field of Search ..... 70/14, 18, 30, 70/49, 57, 58; 248/551–553

(56) References Cited

U.S. PATENT DOCUMENTS 3,101,695 * 8/1963 Honeyman, Jr. .
3,752,254 * 8/1973 Carley et al. ..... 70/230 X
3,841,118 * 10/1974 Stone ..... 70/33
4,057,982 * 11/1977 Drayton ..... 70/14
4,979,382 * 12/1990 Perry ..... 70/232 X
5,184,798 * 2/1993 Wilson ..... 248/551
5,398,530 * 3/1995 Derman ..... 70/18 X
5,481,888 * 1/1996 Perry ..... 70/18
5,642,634 * 7/1997 Perry ..... 70/18
5,722,266 * 3/1998 Yeager et al. ..... 24/18 X

* cited by examiner

*Primary Examiner*—Lloyd A. Gall
(74) *Attorney, Agent, or Firm*—Monty Koslover

(57) ABSTRACT

A coupler device for securing an additional wire rope cable without a lock to a wire rope cable with a lock on one end. The coupler includes an internal planar cavity and cavity openings that are sized and arranged to allow a first cable without a locked end to pass through the cavity and allow a second cable having a loop end and a distal locked end to pass its loop end through the device in a direction orthogonal to the plane of the cavity, resulting in the second cable crossing above and adjacent to the first cable, preventing its removal from the coupler. The coupler devices present a simple method of coupling and securing to each other a variety of cable configurations, including securing a cable to a shaft or padlock.

13 Claims, 2 Drawing Sheets

SECURITY CABLE COUPLING DEVICE

BACKGROUND OF THE INVENTION

1. Field of the Invention

This invention relates to devices for securing small portable equipment from theft, and more particularly to a wire rope cable coupling device for securing a wire rope cable without a lock to another cable having a lock on one end for securing portable equipment.

2. Background

Wire rope cables are used in many security applications for small portable equipment. In a typical application, a wire rope cable having a lock on one end and loop on its distal end, has the lock end being pulled around a secured location such as a post, passing the lock end through the loop end and being attached to an equipment such as a PC.

If it is desired to secure an additional equipment with a wire rope cable in close proximity to the locking wire rope cable described above, another lock requiring a key or combination number is needed. It would therefore be useful to have a simple method to secure an additional wire rope cable without a lock to a cable with a lock on one end.

SUMMARY OF THE INVENTION

The device is a planar coupler made of rigid material and having a thickness sufficient to accommodate a wire rope cable. The coupler incorporates an internal planar cavity and cavity openings that are sized and arranged to allow a first wire rope cable without a locked end to pass through the coupler in a first plane, and allow a second cable having a loop end and a distal locked end to pass its loop end through the coupler in a plane that is orthogonal to the first plane. The cavity and openings are designed such that insertion of the second cable in the device prevents removal of the first cable. The coupler design permits several variations of cable coupling, increasing the number of possible applications for coupler use.

It is therefore a prime object of this invention to provide a simple means of securing an additional wire rope cable without a lock to a wire rope cable having a lock on one end.

An advantage of this invention over other coupler devices is its direct fit with wire rope cables, together with the variety of cable configurations that may be used.

Further objects and advantages of the invention will be apparent from studying the following portion of the specification, the claims and the attached drawings.

DESCRIPTION OF THE PREFERRED AND ALTERNATE EMBODIMENTS

Figure 1:
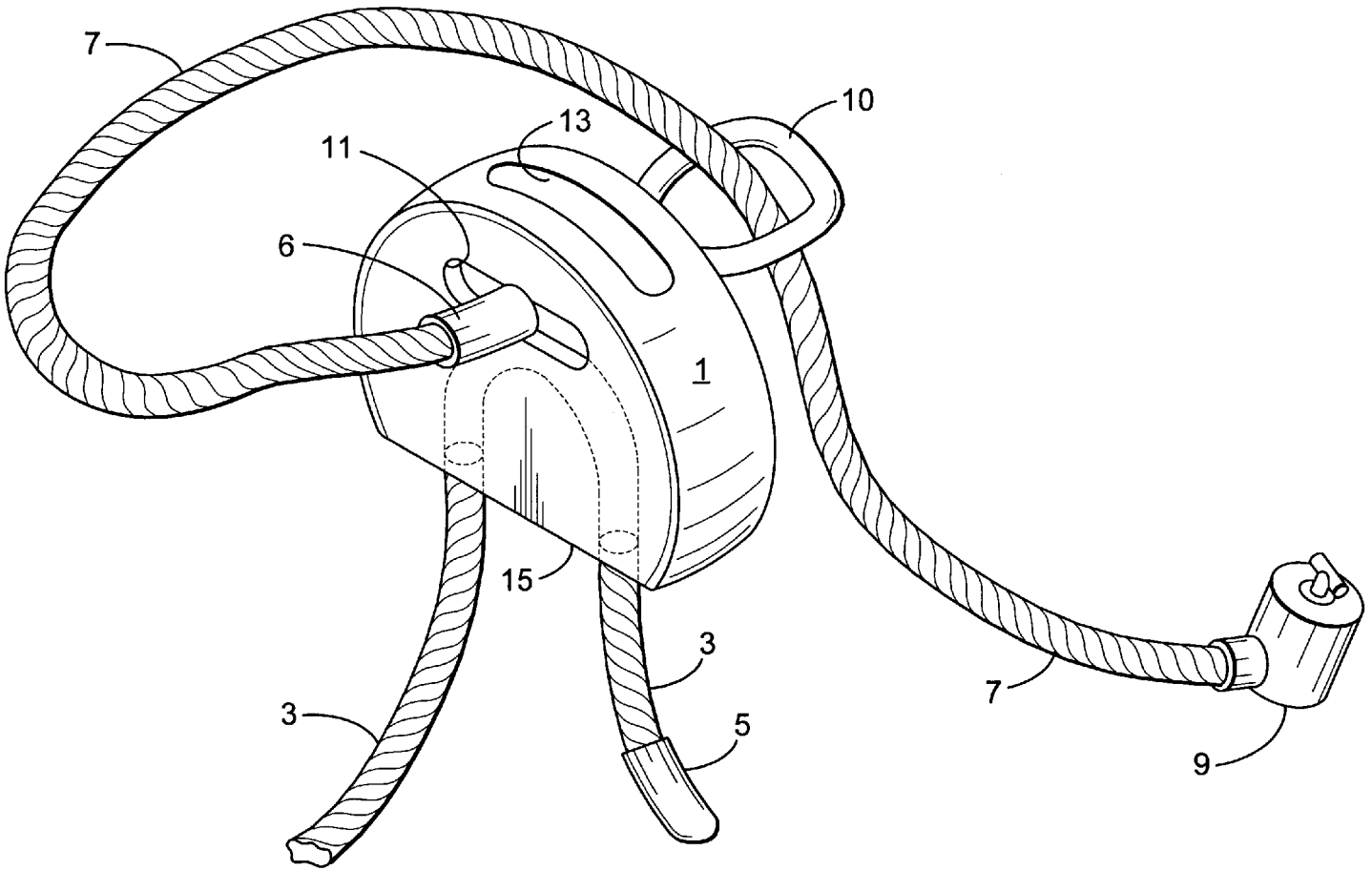
FIG. 1 is a perspective view of a preferred embodiment of the present invention wire rope cable security coupler 1, showing one wire rope cable configuration having locked and looped ends connected to another wire rope cable having no lock or loop end.
Figure 3:
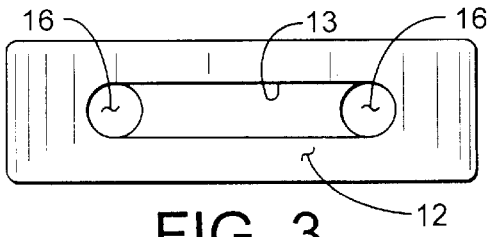
FIG. 3 is a top view of the coupler device, particularly showing a top slotted entrance to an internal cavity and to cable passages.

Referring particularly to the drawings, there is shown in FIG. 1 a perspective view of a preferred embodiment of the present invention coupler 1, showing two wire rope cable configurations securely connected by the coupler 1 to each other. In use, a wire rope security first cable 3 having a swaged end 5 and no locking end is inserted in the coupler 1 by its swaged end 5. The end 5 is pushed through either one of two paralleled passage openings in the bottom edge 15 of the coupler until the end 5 exits through an internal cavity 13 opening in the top edge of the device. The first cable 3 is then folded in a loop and the end 5 reinserted in the top opening of the internal cavity 13. The cable end is pushed through the second parallel passage until it exits through the adjacent passage opening in the bottom edge 15 of the device. The first cable 3 can then be pulled tightly by both ends until the cable fold is firmly seated in the device. A second cable 7 having a loop end 10 can then have its loop end 10 inserted in a slot 11 cut through the coupler and pulled through the slot until stopped by a loop clamp 6. After this, the locked end 9 may be passed through the loop end 10.

The slot 11 is sized and located so that the inserted second cable 7 loop 10 surfaces will bear closely on the fold of the first cable 3 which is inside the coupler device. This of itself will normally suffice to secure the first cable 3. However, should the first cable 3 be pulled to go around the internal cavity curve, its' swaged end 5 will not bend under the cable loop 10 which is above it, preventing the first cable 3 from being pulled through and out of the device and securing the cables to each other.

As an alternate locking arrangement, the second cable 7 may have the cable length near its locked end formed into a loop and have this cable loop inserted through the slot 11. The fixed loop 10 of the cable 7 may then be inserted through the formed cable loop that protrudes through the slot 11.

In FIG. 1, the second cable 7 is shown as having attached on one end, a lock 9 of the type used for fastening to a slot in a portable equipment, and having a loop 10 on its distal end. The coupler 1 would also work well with a second cable 7 having a bulbous end or a swaged end in place of a lock 9. The first cable 3, while having one swaged end 5, may have a bulbous distal end, a locked distal end or another free swaged end if so desired. Thus there are at least three variations in the second cable configuration and three more variations in the first cable configuration that can use the coupler 1 to make a secure connection between the two cables.

Refer now to FIGS. 2, 3, 4 and 5 which are respectively, views of the coupler device 1 front elevation, top edge, side elevation and bottom edge. The device 1 is a disk member made from a slab or sheet of rigid material such as a hard plastic, and which has incorporated an internal cavity 13 in its vertical plane and a slot 11 cut orthogonal to the cavity. The disk member thickness is at least three times the diameter of the cables that it must accommodate in order to allow for the internal cavity 13 and cable passages 16.

Figure 2:
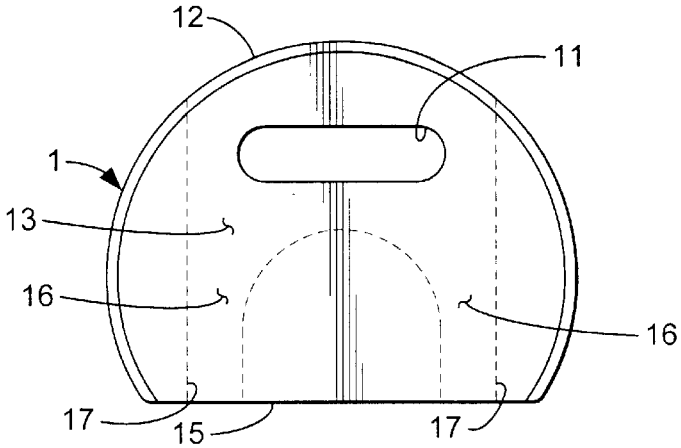
FIG. 2 is a front elevational view of the coupler according to the present invention.
Figure 4:
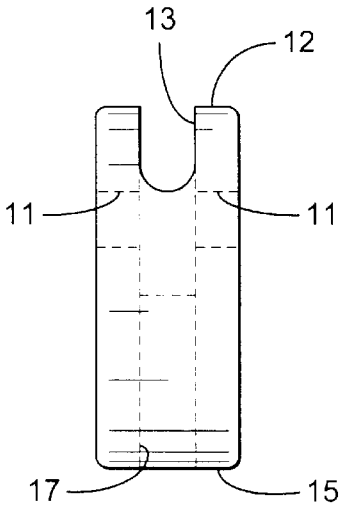
FIG. 4 is a side elevation view of the coupler device.
Figure 5:
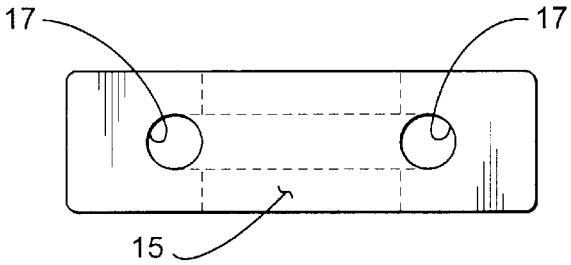
FIG. 5 a bottom view of the coupler device, particularly showing the location of cable passage holes for insertion and exit of a wire rope cable.

The disk member is generally circular in shape with a tangential segment removed, forming a straight bottom edge 15 as shown in FIGS. 2 and 4. This is considered to be best suited for the device application. However, other coupler disk shapes may also be used if warranted by a particular application, providing only that the openings and internal cavity size, shape and locations are as described herein.

The internal cavity 13 is formed vertically in the center plane of the disk member and centered on the member axis, having a width about six times a cable diameter and a depth sized to allow a cable swaged end to pass through the cavity. The cavity 13 is fully open to the top edge 12 of the member and continues down to the approximate center of the disk member, after which the cavity 13 is bifurcated, forming two vertical, parallel passages 16 that are sized for a cable and have openings 17 at the bottom edge 15 of the device. These openings 17 and passages 16 are separated by a space of about four times the cable diameter, to allow for looping a cable over the passages at the center of the disk while inserting and tightening the cable in place. The diameter of the openings 17 and the passages 16 are made such that a first cable 3 swaged end 5 will fit snugly, allowing only cable sliding movement. As a result, a cable swaged end 5 which is in a first passage 16 in the device and can not bend, can not be made to turn 90 degrees to enter the device second passage for exit by pulling it through.

The horizontal slot 11, which is centered on the disk member vertical axis, is cut through so that the slot 11 appears on both sides of the member. The slot 11 provides an opening through which a second cable 7 having a lock and a looped end can pass its looped end in a plane at 90 degrees (orthogonal) to the plane of the internal cavity 13 and thereby also the plane of an inserted first cable 3. The slot 11 is located above the disk central axis just sufficiently so that a cable loop inserted through the slot 11 will pass close above the looped portion of an inserted first cable 3 as shown in FIG. 1. This ensures that insertion of a second cable 7 in the slot 11 will secure a first cable 3 that has been inserted through the cavity passages 16 and prevent it from being pulled out.

Figure 6:
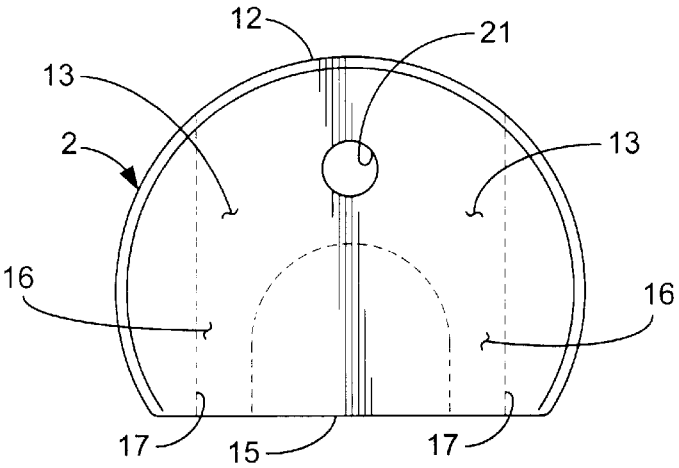
FIG. 6 is a front elevational view of an alternate embodiment coupler device according to the present invention; and, FIG. 7 is a side elevation view of the alternate embodiment coupler device.
Figure 7:
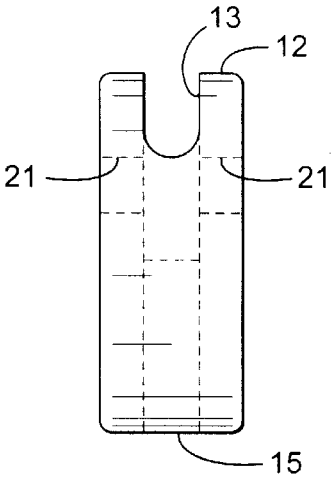

Refer now to FIGS. 6 and 7 which are respectively a front elevation view and a side elevation view of an alternate embodiment coupler device 2. This alternate embodiment is identical to the preferred embodiment in all but one aspect; the slot 11 of the preferred embodiment is replaced by a through hole 21. The through hole 21 is located above the disk 2 central axis just sufficiently so that a cable or shaft inserted through the hole 21 will pass closely above the looped portion of an inserted first cable. The hole 21 diameter may be sized particularly for a given shaft or for a wire rope cable, resulting in a variety of applications for alternate embodiment coupler device. As an example, (a) the second cable can have either a loop, a bulbous portion or a lock on one end and a distal swaged end, with the swaged end passing through the hole 21;
(b) a padlock arm can be passed through the hole 21; and
(c) a shaft with an end that can be locked can be passed through.

In describing the foregoing device embodiments, it should be clearly understood that the coupler device is specifically designed to interact with and secure wire rope security cables one to another. However, there are a variety of cable pair configurations listed above, for which the coupling device may be used. For the alternate embodiment coupling device, cable, padlock and shaft configurations in the second through hole can be used in combination with at least three variations of first cable 3 configurations that have one end swaged as described earlier for the preferred embodiment.

As a result, it is apparent that both embodiments of the coupler device described herein, between them offer a variety of coupling combinations for wire rope security cables.

An advantage of the present invention coupler device is that it will also work well with an inserted shaft or a padlock. The device is simple to use, economical to produce and may be sized to closely fit any selected wire rope cable or shaft.

From the foregoing description, it is believed that the preferred and alternate embodiments achieve the objects of the present invention. Various modifications and changes may be made to the coupler device described above which are apparent to those skilled in the art. These alternatives and modifications are considered to be within the scope of the appended claims and are embraced thereby.

What is claimed is:

1. A coupling device for wire rope cables, comprising a hard, substantially planar member having a top edge, a bottom edge and two parallel faces separated by the member thickness, said member thickness being at least three times the diameter of said wire rope cables, said member including an internal cavity formed vertically in the center plane of said member between said two parallel faces, said cavity having a width about six times a wire rope cable diameter and a depth sized to allow a cable swaged end to pass through said cavity, said cavity extending to said top edge of said member and extending downwards to said bottom edge, said cavity becoming bifurcated at about halfway between said top edge and said bottom edge, and forming two vertical, parallel passages having openings in said bottom edge and separated apart by a space sufficient to allow for a first cable with a swaged end to be inserted in a first passage and looped over to a second passage inside said internal cavity for insertion in said second passage for returning said swaged end of said first cable to said bottom edge, said member including a horizontally extending slot in said parallel faces of said member and communicating with said internal cavity, said slot having a length sufficient for a second cable with a lock on one end and a loop on its distal end to have its loop end inserted in said slot and through said member in a plane orthogonal to the plane of said cavity and the direction of a first cable that is inserted in said member for securing, said slot being located centrally above said first and second passages at a distance such that an insertion of said loop end of said second cable through said slot causes said loop end cable to be adjacent to said first cable, preventing said first cable from being pulled out of said coupling device and securing said first cable to said second cable.

2. The coupling device as defined in claim 1, wherein said first and second passages have a diameter that fits closely slidingly over said swaged end of said first cable, thereby preventing said swaged end from passing round a corner or sharp curve inside said cavity and exiting said device.

3. The coupling device as defined in claim 1, wherein said slot has a length sufficient to allow a cable loop formed by any given portion of said second cable to be passed through said slot.

4. The coupling device as defined in claim 1, wherein said cavity allows insertion of a first cable having a bulbous end and a distal swaged end, said swaged end being inserted in said first passage, folded back into said second passage and pulled through, thereby seating said first cable in said device.

5. The coupling device as defined in claim 1, wherein said cavity allows insertion of a first cable having a lock end and a distal swaged end, said swaged end being inserted in said first passage, folded back into said second passage and pulled through, thereby seating said first cable in said device.

6. The coupling device as defined in claim 1, wherein said slot allows insertion of a second cable having a bulbous end and a distal loop end, said loop end being inserted in said slot and pulled partially through said device, thereby securing said first cable to said second cable.

7. The coupling device as defined in claim 1, wherein said slot allows insertion of a second cable having a swaged end and a distal loop end, said loop end being inserted in said slot and pulled partially through said device, thereby securing said first cable to said second cable.

8. A coupling device for wire rope cables, comprising a hard, substantially planar member having a top edge, a bottom edge and two parallel faces separated by the member thickness, said member thickness being at least three times the diameter of said wire rope cables, said member including an internal cavity formed vertically in the center plane of said member between said two parallel faces, said cavity having a width about six times a wire rope cable diameter and a depth sized to allow a cable swaged end to pass through said cavity, said cavity extending to said top edge of said member and extending downwards to said bottom edge, said cavity becoming bifurcated at about halfway between said top edge and said bottom edge, and forming two vertical, parallel passages having openings in said bottom edge and separated apart by a space sufficient to allow for a first cable with a swaged end to be inserted in a first passage and looped over to a second passage inside said internal cavity for insertion in said second passage for returning said swaged end of said first cable to said bottom edge, said member including a first hole through said parallel faces of said member and communicating with said internal cavity, said first hole being sized for a second cable having a lock on one end and a swaged distal end to have its swaged end inserted in said first hole and through said member in a plane orthogonal to the plane of said cavity and the direction of a first cable that is inserted in said member for securing, said first hole being located centrally above said first and second passages at a distance such that an insertion of said second cable through said first hole causes said second cable to be adjacent to said first cable, preventing said first cable from being pulled out of said coupling device and securing said first cable to said second cable.

9. The coupling device as defined in claim 8, wherein said first and second passages have a diameter that fits closely slidingly over said swaged end of said first cable, thereby preventing said swaged end from passing round a corner or sharp curve inside said cavity and exiting said device.

10. The coupling device as defined in claim 8, wherein said first hole allows insertion of a second cable having a bulbous end and a distal swaged end, said swaged end being inserted in said first hole and pulled through said device, thereby securing said first cable to said second cable.

11. The coupling device as defined in claim 8, wherein said first hole allows insertion of a second cable having a looped end and a distal swaged end, said swaged end being inserted in said first hole and pulled through said device, thereby securing said first cable to said second cable.

12. The coupling device as defined in claim 8, wherein said first hole is sized to allow insertion of a shaft, said shaft having a lockable end, said shaft being inserted in said first hole and pushed through said device, thereby bearing on said first cable and securing said first cable to said shaft.

13. The coupling device as defined in claim 8, wherein said first hole is sized to allow insertion of a padlock arm, said padlock arm being inserted in said first hole and pushed through said device, thereby bearing on said first cable and securing said first cable to said padlock.

* * * * *